US011944145B1

(12) United States Patent
Shim

(10) Patent No.: US 11,944,145 B1
(45) Date of Patent: Apr. 2, 2024

(54) WIG CAPABLE OF FORMING VOLUME WITH WIG YARN AND METHOD FOR MANUFACTURING SAME

(71) Applicant: Hyun Joo Shim, Seoul (KR)

(72) Inventor: Hyun Joo Shim, Seoul (KR)

( * ) Notice: Subject to any disclaimer, the term of this patent is extended or adjusted under 35 U.S.C. 154(b) by 0 days.

(21) Appl. No.: 18/467,142

(22) Filed: Sep. 14, 2023

(30) Foreign Application Priority Data

Aug. 29, 2023 (KR) ..... 10-2023-0113917

(51) Int. Cl.
*A41G 3/00* (2006.01)

(52) U.S. Cl.
CPC ..... *A41G 3/0066* (2013.01); *A41G 3/005* (2013.01); *A41G 3/0075* (2013.01)

(58) Field of Classification Search
CPC ..... A41G 3/005; A41G 3/0066; A41G 3/0075
See application file for complete search history.

(56) References Cited

U.S. PATENT DOCUMENTS 3,490,397 A * 1/1970 Klassert ..... D05C 15/02 112/80.02
3,589,376 A * 6/1971 Kohler ..... A41G 3/0075 132/201
3,794,933 A * 2/1974 Moorhead ..... A41G 3/0066 132/201
4,739,777 A * 4/1988 Nelson ..... A41G 3/00 132/53
5,044,382 A * 9/1991 Ando ..... A41G 3/005 132/54
9,516,908 B2 * 12/2016 Miyatake ..... A41G 3/0041
2007/0251536 A1 * 11/2007 Kupitz ..... A41G 3/0066 132/53
2008/0041405 A1 * 2/2008 Kitsu ..... A41G 3/0075 132/201
2014/0283862 A1 * 9/2014 Miyatake ..... A41G 3/0041 132/53
2017/0112212 A1 * 4/2017 Tao ..... A41G 3/0066
2019/0059486 A1 * 2/2019 Kim ..... A41G 3/005

FOREIGN PATENT DOCUMENTS

KR 10-2003-0051940 A 6/2003
KR 10-2064598 B1 1/2020
KR 10-2136818 B1 7/2020

OTHER PUBLICATIONS https://www.wigs.com/blogs/news/the-pros-and-cons-of-permatease?utm_source=google&utm_medium=cpc&utm_campaign=227147530&utm_term=&gclid=CjwKCAiA2pyuBhBKEiwApLalO9RVjUA5yj4cdYn5pCQKYw32LpXSGCw8ZcaXh3mtZB_XkOg4BT6bMRoCOjAQAvD_BwE&target_id=dsa-45621710049&ad_type=&gad_source=1 (Year: 2022).*

* cited by examiner

*Primary Examiner* — Tatiana L Nobrega
(74) *Attorney, Agent, or Firm* — NKL Law; Jae Youn Kim

(57) ABSTRACT

The present technology relates to a wig capable of naturally implementing a wave with wig yarns without using an additional beauty tool by regularly knotting long hairs and short hairs in an arbitrarily set region of a hair net, and more specifically, to a wig shaped by knotting natural or artificial hairs, which are wig yarns, on a hair net formed in a head shape, in which the wig includes a non-wave area where long hairs are knotted and a wave area where the long hairs and short hairs are knotted to have an area of a regular pattern, thereby allowing the long hairs resting on the short hairs to have a volume, in which the wave area includes a long hair section where long hairs are knotted and a short hair section where short hairs are knotted.

3 Claims, 8 Drawing Sheets

WIG CAPABLE OF FORMING VOLUME WITH WIG YARN AND METHOD FOR MANUFACTURING SAME

BACKGROUND OF THE INVENTION

1. Field of the Invention

The present technology relates to a wig capable of naturally implementing a wave with wig yarns without using an additional beauty tool by regularly knotting long hairs and short hairs in an arbitrarily set region of a hair net.

2. Description of the Prior Art

In general, wigs are worn by people who do not have a lot of hairs or have a bald head due to a partial or total hair loss in order to hide the same, but recently wigs have been used as a fashion tool to express people's own unique and different individuality.

The wigs are made in the form of a mesh net, and may be classified into a handmade wig and a sewing wig according to whether the wig is made by knotting wig yarns manually or by a sewing machine in a cap having a head shape using mannequin, etc., and the wig may be divided into a whole wig for covering an entire head and a partial wig for covering only a portion having thin hair according to a use thereof.

The wigs are usually composed of wig yarns such as artificial hair, human hair, or the like and a cap at which hairs are knotted and which is detachably fixed to a head.

In particular, as shown in FIG. 1, there is provided a whole wig 10 in which a user may selectively change a hairstyle through a basic shape where the wig yarns of long hair only hang down in one direction, that is, downwardly so as to be symmetrical to each other based on a parting line P/L.

In other words, when a user desires to form a volume in the front of a head, a conventional whole wig has a problem in that a direction of knotted wig yarns is made in one way, and whether or not the wig is worn is easily recognized due to unnaturalness in which a natural volume is not implemented due to a weight of the corresponding wig yarns, and sustainability of the formed wave is deteriorated.

RELATED ART REFERENCES

Patent Documents

Korean Registered Patent No. 10-2064598 (publicized on Jan. 9, 2020)

Korean Registered Patent No. 10-2136818 (publicized on Jul. 23, 2020)

Korean Unexamined Patent No. 10-51940 (publicized on Jun. 26, 2020)

SUMMARY OF THE INVENTION

In order to solve the conventional problems described above, an object of the present invention is to provide a wig in which a knotting section and a pattern of wig yarns are arbitrarily set to form a natural wave using the wig yarns so that whether or not the wig is worn may not be easily recognized and sustainability of the formed wave may be improved.

In order to solve the problems in the related art as described above, a wig capable of forming a volume with wig yarns according to the present invention may be a wig formed by knotting natural or artificial hairs, which are wig yarns, on a hair net 100 formed in a head shape, in which the wig may include a second area or non-wave area 200 where long hairs are knotted and a first area or wave area 300 where the long hairs and short hairs are knotted to have an area of a regular pattern, thereby allowing the long hairs resting on the short hairs to have a volume, in which the first area or wave area 300 may include a long hair section 310 where long hairs are knotted and a short hair section 320 where short hairs are knotted.

In addition, it may be preferable that the long hairs and short hairs knotted in the long hair section 310 and the short hair section 320 are knotted to have inclinations in different directions.

Furthermore, it may be preferable that the first area or wave area 300 includes a first long hair section 311 leading to a parting line 120, a first short hair section 321 leading to the first long hair section 311, a second long hair section 313 leading to the first short hair section 321, and a second short hair section 323 leading to the second long hair section 313.

Moreover, it may be preferable that an area of the first long hair section 311 is formed to have a larger area compared to the first short hair section 321, the second long hair section 313, and the second short hair section 323.

According to the present invention, differently from the related art, a long hair section in which long hairs having a predetermined area are knotted and a short hair section in which short hairs are knotted can be formed into at least one unit with respect to a first area or wave area arbitrarily partitioned in a hair net, thus having an effect of forming a volume or natural waves having different heights with wig yarns.

DETAILED DESCRIPTION OF THE INVENTION

Figure 1:
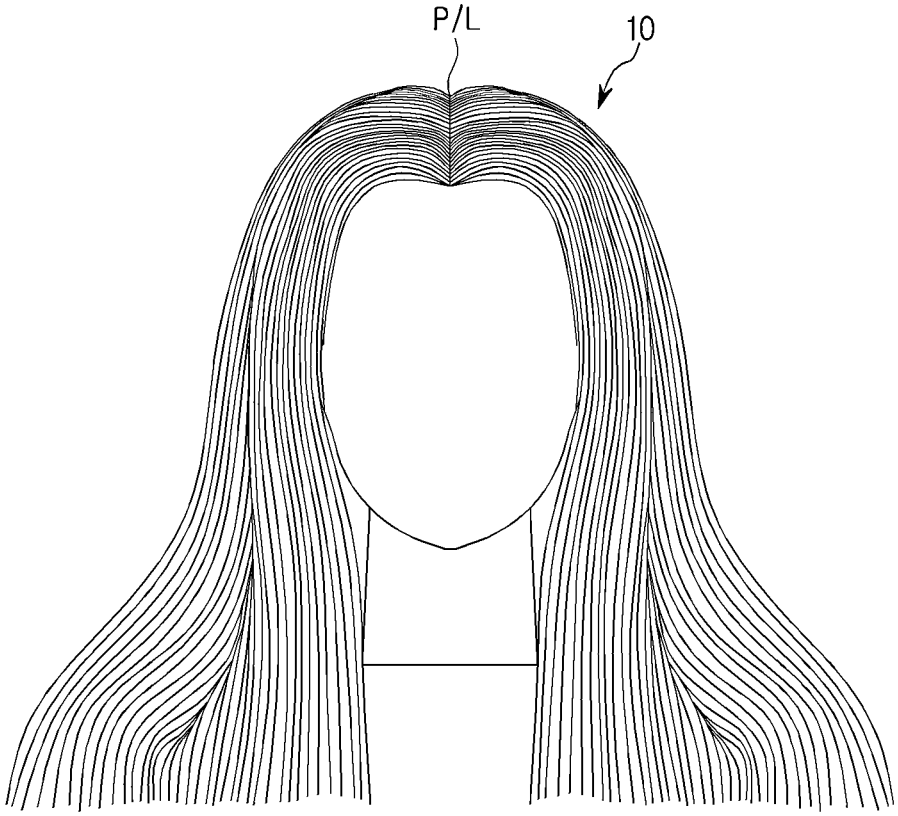
FIG. 1 PRIOR ART
FIG. 1 is a view showing a conventional wig with long hairs knotted.

Hereinafter, the present invention will be described in more detail with reference to the accompanying drawings. The embodiments described in the present specification may be variously modified. Specific embodiments are depicted in the drawings and may be described in detail in the detailed description. However, the specific embodiments disclosed in the accompanying drawings are only for easy understanding of various embodiments. However, the technical idea is not limited by the specific embodiments disclosed in the accompanying drawings, and it should be understood that the present invention includes all equivalents and replacements included in the spirit and technical scope of the present invention.

Terms including ordinal numbers such as first, second, etc., may be used to describe various components, but the components are not limited by the above terms. The terms described above may be used only for distinguishing one component from other components.

In the present specification, the terms "including," "having" or the like are used to designate that the features, numbers, steps, operations, elements, components or combinations thereof described in the specification are present, and are not to be understood as excluding the possibility that one or more other features, numbers, steps, operations, elements, components, or combinations thereof may be present or added. When one element is described as being "connected" or "accessed" to another element, it shall be construed as being connected or accessed to the other element directly but also as possibly having another element in between. On the other hand, if one element is described as being "directly connected" or "directly accessed" to another element, it shall be construed that there is no other element in between.

Besides, in the description of the present invention, a detailed description of related known functions or configurations will be abbreviated or omitted when it may make the subject matter of the present invention unnecessarily unclear.

Hereinafter, a wig capable of forming a volume with wig yarns according to the present invention (hereinafter, simply referred to as a "wig") will be described in detail with reference to the accompanying drawings.

Prior to the description, it may be described hereinafter as an embodiment that wave areas 300 are formed at both sides based on a parting line 120 arbitrarily partitioned in a hair net 100, but this is merely one embodiment. It is noted that the wave areas 300 may be formed at any one side based on a corresponding parting line 120 as necessary, and it is noted that the parting line 120 may be used in a biased manner rather than at an center of the hair net 100.

Figure 2:
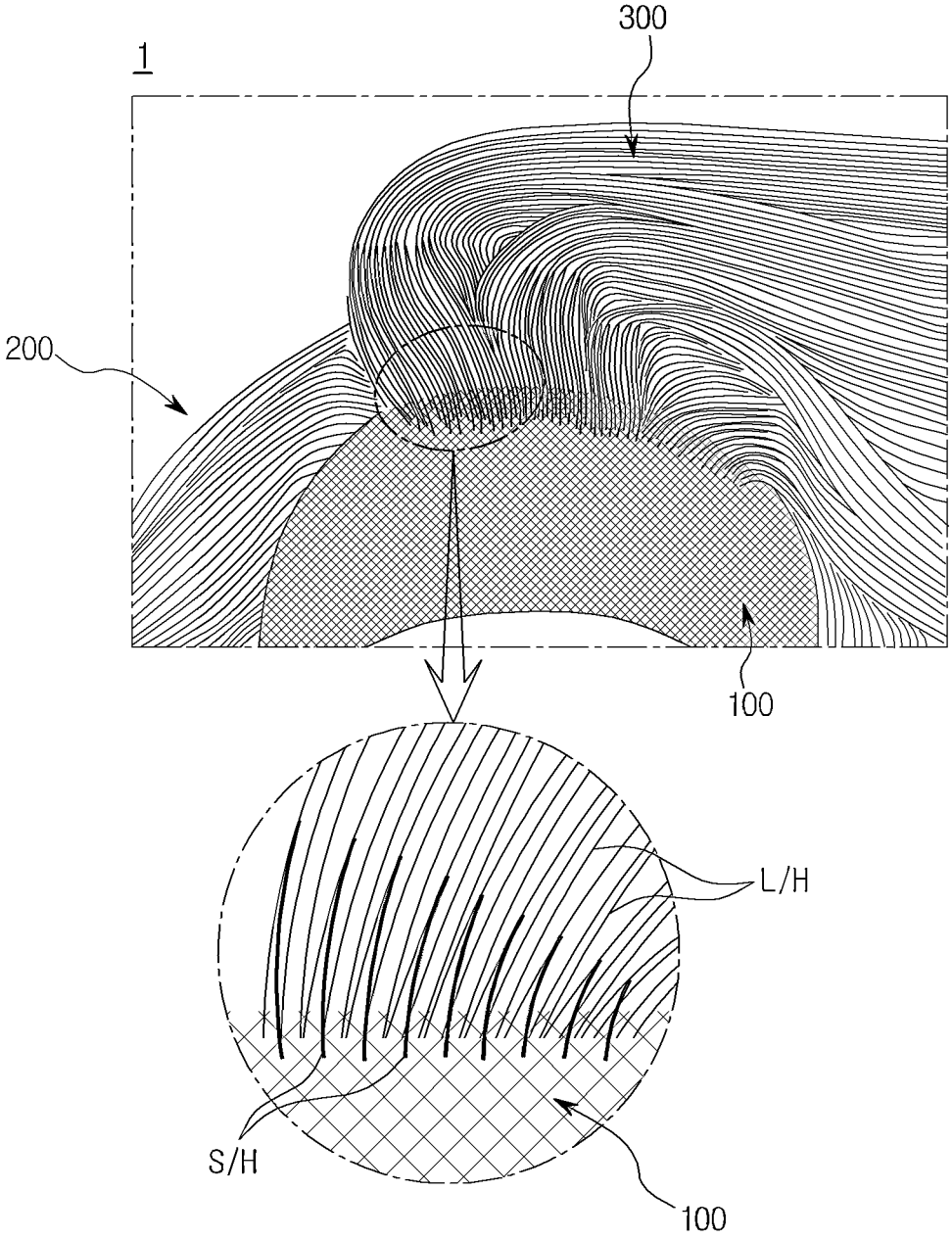
FIG. 2 is a view showing a wig capable of forming a volume with wig yarns according to the present invention.

First, as shown in FIG. 2, a wig 1 according to the present invention may largely include a hair net 100, a second area or non-wave area 200, and a first are or wave area 300, and a wig yarn described below may include a long hair L/H and a short hair S/H, which are at least one of natural hair and artificial hair.

Here, a length of the short hair S/H may refer to a wig yarn having a length of at least 2 cm, and a length of the long hair L/H may refer to a wig yarn having a longer length compared to the corresponding short hair S/H.

Figure 3:
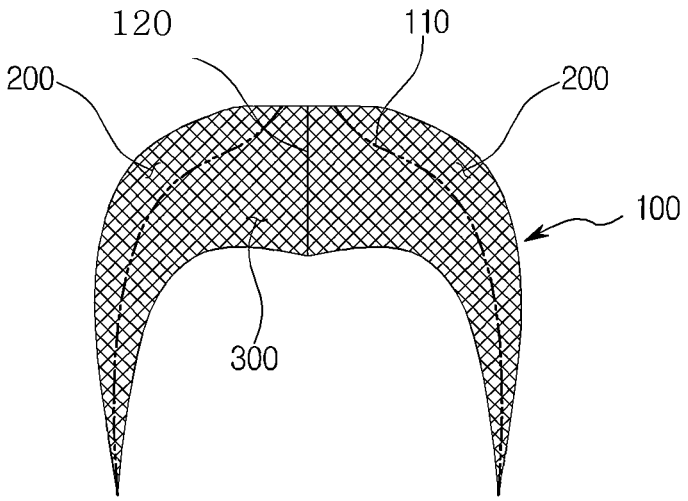
FIG. 3 is a view showing a hair net for a wig capable of forming a volume with wig yarns according to the present invention.
Figure 4:
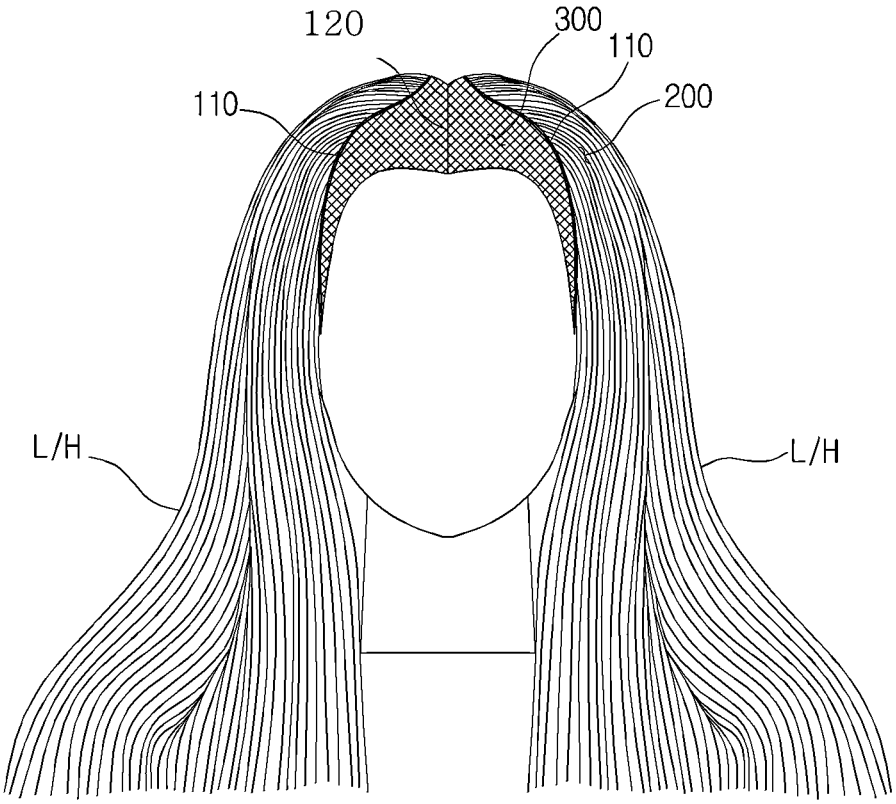
FIG. 4 is a view showing a state in which long hairs are knotted in a second area or non-wave area of FIG. 3.

For example, as shown in FIGS. 3 and 4, the hair net 100 may be configured to partition the second area or non-wave area 200 and the first area or wave area 300 to be described later to provide a space in which the long hairs L/H and the short hairs S/H may be knotted, and may be formed to have a shape corresponding to a head shape of a wearer who wants to use the wig 1 using mannequin, etc.

The hair net 100 may have a mesh shape in which a plurality of pores are formed in order to easily discharge sweat and the like generated from a scalp of the wearer.

The hair net 100 may include a boundary line 110 and a parting line 120 for partitioning the second area or non-wave area 200 and the first area or wave area 300, and the boundary line 110 and the parting line 120 may be displayed and used on the hair net 100 so that worker may visually identify the same as necessary. The first area 300 has a front edge configured to extend along the hairline of the user. The boundary line 110 defines first and second lateral edges of the first area 300, where the first and second lateral edges extend respectively from first and second ends of the front edge of the first area 300. The second area 200 has a forward edge adjacent the first and second lateral edges of the first area 300. Thus, the boundary line separates the first and second areas of the hair net base 100.

In particular, as described above, the parting line 120 may be formed at a center based on an entire area of the hair net 100 or may be formed to be biased in one direction according to a preference of the wearer, so that the first area or wave area 300 may be formed at one side or both sides of the parting line 120 to enable a wave of wig yarns by the long hairs L/H and the short hairs S/H. The parting line 120 extends away from the front edge in a posterior direction toward the crown of the hair net base 100.

In addition, the second area or non-wave area 200 may refer to an area in which only long hairs L/H with short hairs S/H omitted are knotted to hang down without a wave or volume.

The second area or non-wave area 200 in the present invention may refer to a surface of the hair net 100 excluding the first area or wave area 300 to be described later, and may be preferably formed on a side head portion and a back head (back of the head) on one side or both sides of the wearer.

The long hairs L/H knotted in the second area or non-wave area 200 may be knotted to have different lengths to implement a natural hair shape.

In addition, the first area or wave area 300 may refer to an area in which the wig yarns are knotted except for the second area or non-wave area 200 described above, and may be an area for enabling a wave of the long hairs L/H through a knotted pattern of the wig yarns provided in the first area or wave area 300.

For this purpose, in the first area or wave area 300, the long hairs L/H and the short hairs S/H may be knotted in the hair net 100 as different embodiments, and hereinafter, each embodiment will be described with reference to FIGS. 5 to 7.

Here, the first area or wave area 300 may be formed so that a first long hair section 311 leading to a parting line 120, a first short hair section 321 leading to the first long hair section 311, a second long hair section 313 leading to the first short hair section 321, and a second short hair section 323 leading to the second long hair section 313 may sequentially have a predetermined area.

In this case, it may be preferable that the long hairs are knotted in the first and second long hair sections 311 and 313 and the short hairs S/H are knotted in the first and second short hair sections 321 and 323, in which the first long hair section 311 is formed to have an area larger than that of other sections, thereby easily forming a wave, as the number of long hairs UH increases. Each of the first and second long and short hair sections are arranged in a side-by-side configuration along a lateral direction, as shown in FIGS. 5 to 7 and each of the first and second long and short hair sections have a length extending along an anterior-posterior direction parallel to the parting area and a width extending transverse to the length. The width of the first long hair section is greater than the width of each of the first and second short hair sections and the second long hair section, such that the area defined by the first long hair section is greater than the individual areas defined by each of the other sections.

Figure 5:
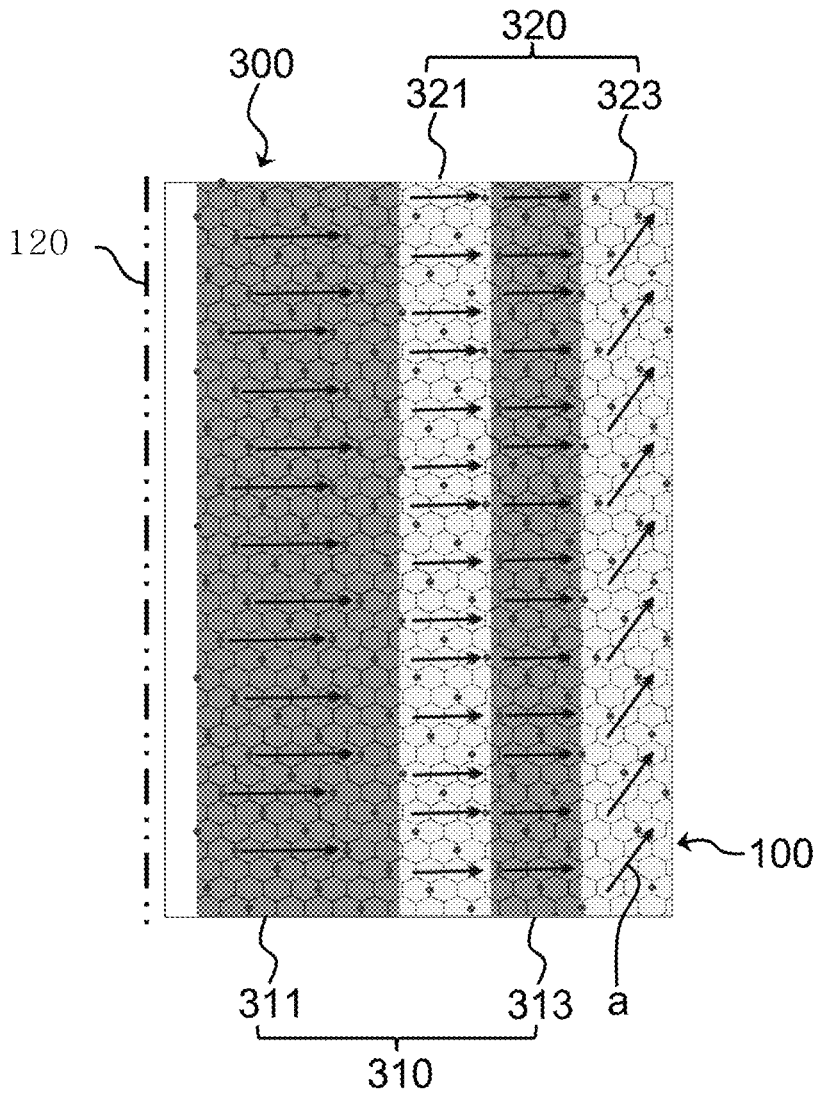
FIG. 5 is a conceptual view showing an embodiment in which long hairs and short hairs are knotted in a first area or wave area of FIG. 3.

First, in a first embodiment as shown in FIG. 5, the first area or wave area 300 of the present invention may be so configured that the long hairs L/H knotted in the first and second long hair sections 311 and 313 and the short hairs S/H knotted in the first short hair section 321 are erected at a right angle as much as possible, and the other short hairs S/H knotted in the second short hair section 323 have an inclination a having an inclination value relatively smaller than a right angle.

Here, the long hairs L/H knotted in the first and second long hair sections 311 and 313 and the short hairs S/H knotted in the first short hair section 321 may be knotted close to vertically, while the short hairs S/H knotted in the second short hair section 323 may be further tilted at an angle of about 30 to 50 degrees, that is, have an angle which the short hairs may be tilted toward the hair net 100, as compared with the short hairs S/H knotted in the first short hair section 321.

Figure 6:
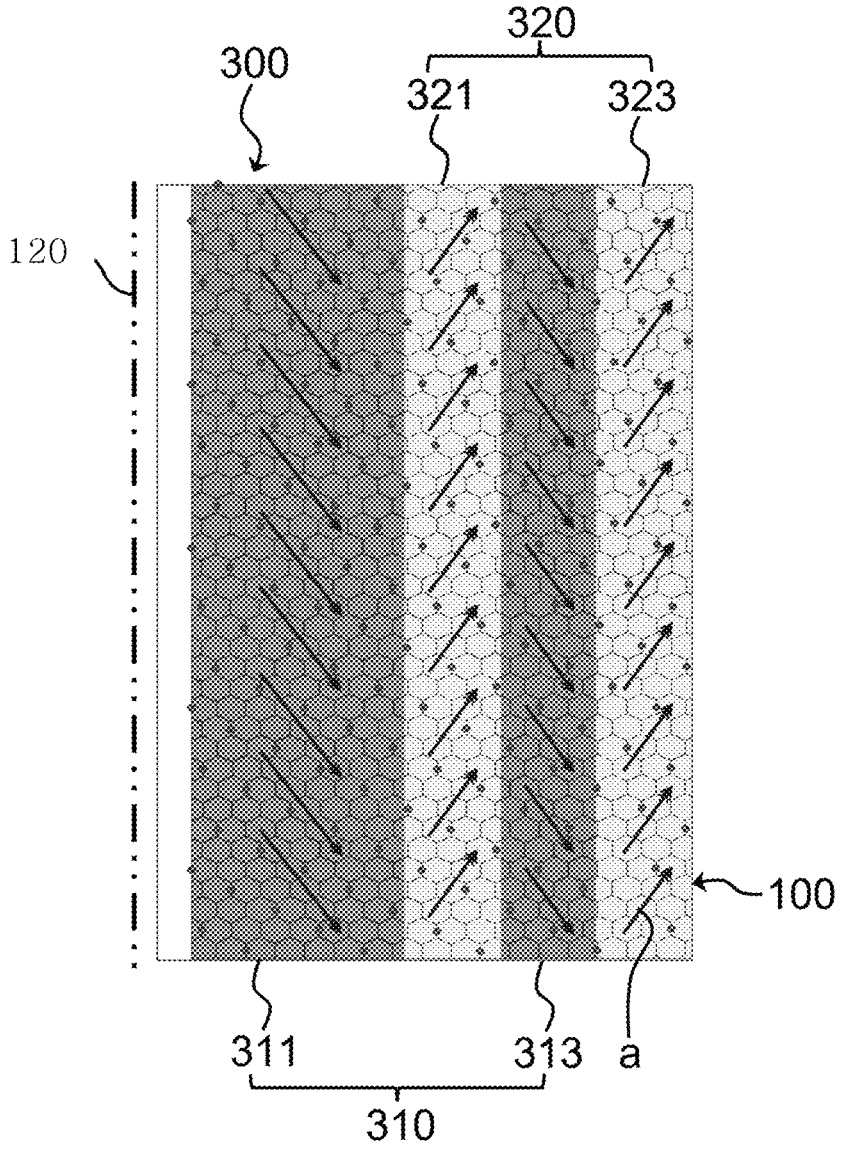
FIG. 6 is another embodiment of FIG. 5.

Moreover, in a second embodiment as shown in FIG. 6, the first area or wave area 300 of the present invention may be so configured that the long hairs L/H knotted in the first and second long hair sections 311 and 313 and the short hairs S/H knotted in the first and second short hair sections 321 and 323 are knotted to have an inclination so that the short hairs may be tilted in different directions, thereby forming a wave.

In this case, it may be preferable that the long hairs L/H and the short hairs S/H are respectively knotted to have the same inclination or different inclinations.

Figure 7:
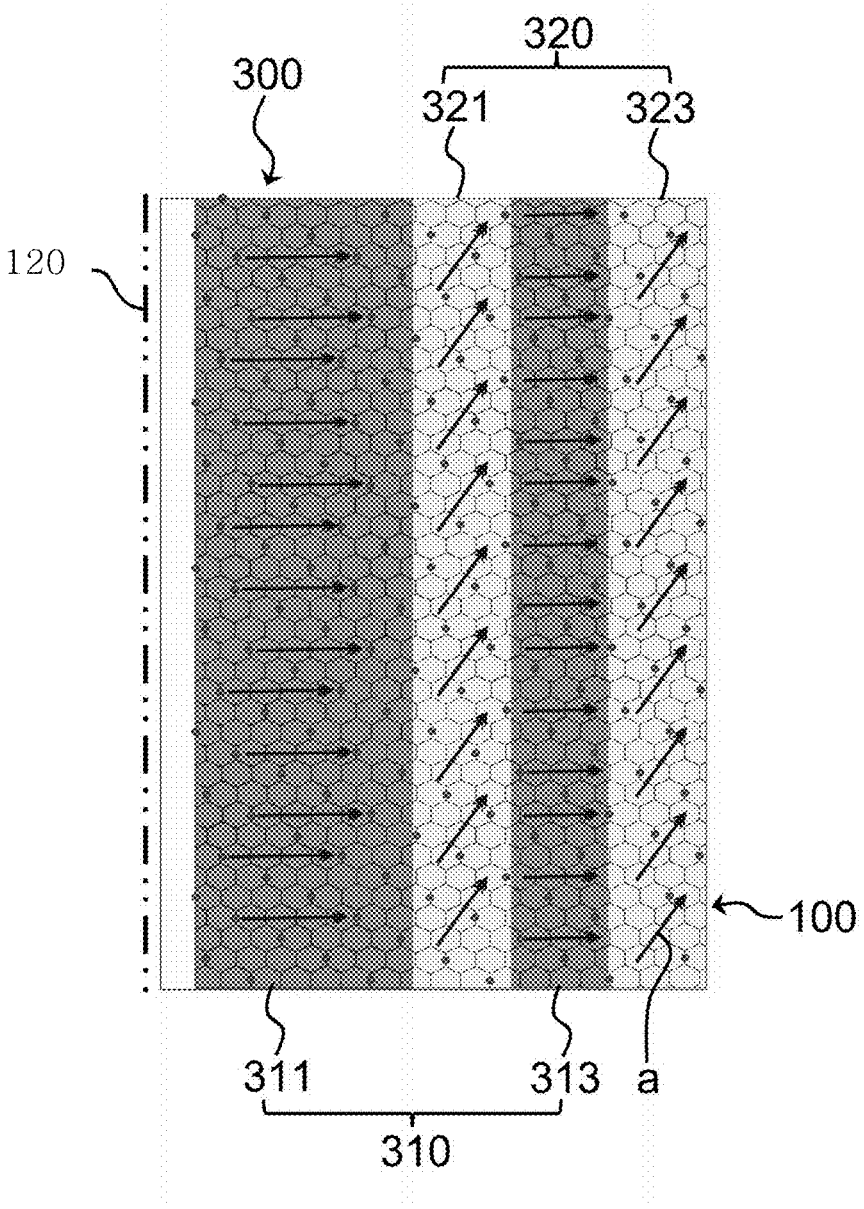
FIG. 7 is still another embodiment of FIG. 5.

Furthermore, in a third embodiment as shown in FIG. 7, the first area or wave area 300 of the present invention may be so configured that the long hairs L/H knotted in the long hair section 310 are knotted close to vertically, and the short hairs S/H knotted in the short hair section 320 are knotted to have a predetermined inclination, thereby forming a wave.

Of course, in the third embodiment, the long hairs of the long hair section 310 may be obliquely knotted as necessary, and the short hairs S/H knotted in the short hair section 320 may be oppositely formed close to vertically.

In any one of the first to third embodiments described above, when the wearer performs first area or brushing with a comb or the like after the long hairs L/H and short hairs S/H are knotted in the wave area 300, the long hairs L/H knotted in the long hair section 310 may hang down in a direction of the brushing and may be simultaneously supported at an upper end of the short hairs S/H knotted in the short hair section 320 by a load, thereby having an advantage of naturally forming a wave and, in particular, differently applying the wave heights of the long hairs L/H knotted in the first long hair section 311.

Meanwhile, in the first to third embodiments described above, the long hairs L/H knotted in the long hair section 310 and the short hairs S/H knotted in the short hair section 320 may be used by being knotted in the hair net 100 to have a zigzag pattern, and the number of cases in which the long hairs L/H may be supported by the short hairs S/H may be increased through the zigzag pattern, thereby more easily implementing the wave formation.

Hereinafter, a method for manufacturing a wig capable of forming a volume with wig yarns according to the present invention (hereinafter, simply referred to as "a method for manufacturing a wig") will be described in detail with reference to the accompanying drawings.

Figure 8:
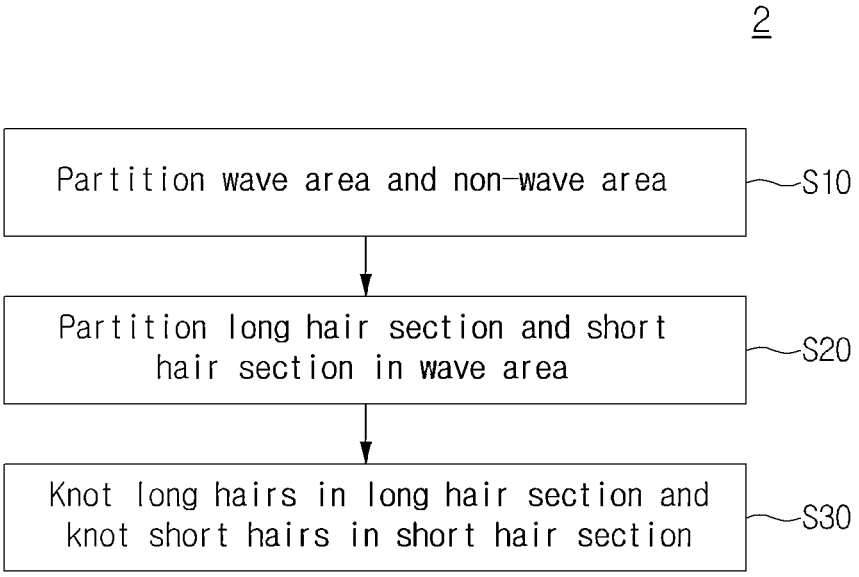
FIG. 8 is a flow chart showing a method for manufacturing a wig capable of forming a volume with wig yarns according to the present invention.

First, as shown in FIG. 8, the method for manufacturing a wig 2 according to the present invention may largely include 1) determining a first area or wave area 300 and a second area or non-wave area 200 in a hair net 100 (S10), 2) arbitrarily partitioning a long hair section 310 and a short hair section 320 in the first area or wave area 300 (S20); and 3) knotting long hairs in the long hair section 310 and knotting short hairs in the short hair section 320 (S30).

In more detail, in order to manufacture the wig 1 according to the present invention, a worker may put the hair net 100 on mannequin or the like having a head formed thereon, and then perform 1) in which the second area or non-wave area 200 and the first area or wave area 300 are arbitrarily formed on the hair net 100 according to a wearer's preference.

Here, the second area or non-wave area 200 and the first area or wave area 300 may be partitioned in the hair net 100 through the parting line 120 and the boundary line 110, and hereinafter it will be described as an example that the parting line 120 may be virtually formed at a central portion (crown) of the hair net 100 and the first area or wave area 300 may be present at both sides based on the parting line 120.

After above 1) is finished, in 2), the worker may arbitrarily partition the first area or wave area 300 into the long hair section 310 including the first and second long hair sections 311 and 313 and the short hair section 320 including the first and second short hair sections 321 and 323 according to a height of a wave by the long hair L/H to be formed.

Here, the worker may partition the long hair section 310 and the short hair section 320 symmetrically to each other on both sides based on the parting line 120 so as to have a predetermined area, and preferably, the first long hair section 311 may be partitioned to be connected to the parting line 120.

At the same time, when the first long hair section 311 is partitioned, the worker may partition the same to be connected to the first short hair section 321 having an area smaller than that of the first long hair section 311, may partition the second long hair section 313 to be connected to the first short hair section 321, and may partition the second short hair section 323 to be connected to the second long hair section 313 so as to be sequentially partitioned in the first area or wave area 300.

After above 2) is finished, 3) may be performed in which the worker knots the long hairs L/H in each of the partitioned first and second long hairs sections 311 and 313 and knots the short hairs S/H in the partitioned first and second short hair sections 321 and 323.

In this case, if necessary, the worker may knot the long hairs L/H and the short hairs S/H in the long hair section 310 and the short hair section 320 to have a zigzag pattern on the hair net 100.

In addition, the worker may knot the long hairs L/H and short hairs S/H by reciting any one of the first to third embodiments described above.

In other words, the first embodiment may be applied when the worker wants to form a height of a wave to be high through the long hairs L/H knotted in the long hair section 310, the second embodiment may be applied when the worker wants to form a height of the wave to be low through the corresponding long hairs L/H compared to the first embodiment, and the third embodiment may be applied when the workers wants to simultaneously implement a wave of the long hairs L/H knotted in the first and second long hair sections 311 and 313 as well as a volume such as a waveform for the entire first area or wave area 300.

As described above, differently from the related art, the wig 1 according to the present invention may be so configured that the long hair section 310 where the long hairs L/H having a predetermined area are knotted and the short hair section 320 where the short hairs S/H are knotted are formed into at least one unit with respect to the first area or wave area 300 arbitrarily partitioned in the hair net 100, thus having an effect of forming a volume or natural waves having different heights with wig yarns.

As described above, the present invention has been described by particular matters such as specific components, etc., and limited embodiments and drawings, but they are provided only to help a more general understanding of the present invention, and the present invention is not limited to the above embodiments, and those skilled in the art to which the present invention pertains can make various modifications and variations from these descriptions.

Accordingly, the scope of the present invention is not to be limited to the described embodiments, and all those having equal or equivalent modifications to the claims as well as the claims to be described later fall within the scope of the present invention.

DESCRIPTION OF REFERENCE NUMERALS

1: Wig capable of forming a volume with wig yarns according to the present invention
2: A method for manufacturing a wig capable of forming a volume with wig yarns according to the present invention
100: Hair net
110: Boundary line 120: Parting line
200: Non-wave area
300: Wave area
310: Long hair section 311: First long hair section
313: Second long hair section 320: Short hair section
321: First short hair section 323: Second short hair section

What is claimed is:

1. A wig comprising:

a net base having a first area and a second area;

the first area having:

i) a front edge configured to extend along the hairline of the user, where the front edge has opposing first and second ends, ii) first and second lateral edges extending respectively from the first and second ends of the front edge, where the first and second lateral edges taper in a posterior direction away from the front edge such that the first area is symmetrical about a parting line extending through a center of the first area, iii) a first long hair section disposed immediately adjacent the parting line, and a second long hair section, where a plurality of long hairs are knotted to the first and second long hair sections in a first direction, iv) a first short hair section disposed between the first and second long hair sections, and where a plurality of short hairs are knotted to the first short hair section in a second direction or the first direction, vi) a second short hair section disposed immediately adjacent the second long hair section, where a plurality of short hairs are knotted to the second short hair section in the second direction, wherein the first and second long and short hair sections are arranged in a side-by-side configuration along a lateral direction, and each of the first and second long and short hair sections have a length extending along an anterior-posterior direction parallel to the parting line and a width extending transverse to the length, where the width of the first long hair section is greater than the width of each of the first and second short hair sections and the second long hair section, wherein the first and second directions are different; and the second area having a forward edge adjacent the first and second lateral edges of the first area and extends posteriorly to define a rearward portion of the net base, wherein a plurality of long hairs knotted to the second area of the net base.

2. A wig comprising:

a net base having a first area and a second area;

the first area having:

i) a front edge configured to extend along the hairline of the user, where the front edge has opposing first and second ends, ii) first and second lateral edges extending respectively from the first and second ends of the front edge, where the first and second lateral edges taper in a posterior direction away from the front edge, iii) a parting area extending posteriorly from the front edge, iv) a first long hair section disposed immediately adjacent the parting area, where a plurality of long hairs are knotted to the first long hair section in a first direction, v) a first short hair section disposed immediately adjacent the first long hair section, where a plurality of short hairs are knotted to the first short hair section in a second direction, vi) a second long hair section disposed immediately adjacent the first short hair section, where a plurality of long hairs are knotted to the second long hair section in the third direction, vii) a second short hair section disposed immediately adjacent the second long hair section, where a plurality of short hairs are knotted to the second short hair section in a fourth direction, wherein the first and second long and short hair sections are arranged in a side-by-side configuration along a lateral direction, and each of the first and second long and short hair sections have a length extending along an anterior-posterior direction parallel to the parting area and a width extending transverse to the length, where the width of the first long hair section is greater than the width of each of the first and second short hair sections and the second long hair section, and wherein the first second, third and fourth directions provide one of the following configurations: a) the first, second, and third directions are perpendicular to the parting area and the fourth directions is angled in a posterior direction with respect to the parting area, b) the first and third directions are angled in an anterior direction with respect to the parting area and the second and fourth directions are angled in a posterior direction with respect to the parting area, or c) the first and third directions are perpendicular to the parting area and the second and fourth directions are angled in a posterior direction with respect to the parting area; and the second area having a forward edge adjacent the first and second lateral edges of the first area and extends posteriorly to define a rearward portion of the net base, wherein a plurality of long hairs are knotted to the second area of the net base.

3. A method of manufacturing a wig comprising:

providing a hair net;

determining a first area and a second area in the hair net, where the first area has: i) a front edge with opposing first and second ends, the front edge being configured to extend along the hairline of the user, and ii) first and second lateral edges extending respectively from the first and second ends of the front edge, where the first and second lateral edges taper in a posterior direction away from the front edge and define a boundary line between the first and second areas;

determining a parting line in the first area, where the parting line extends posteriorly from the front edge;

delineating a first long hair section disposed immediately adjacent the parting line, a second long hair section, a first short hair section disposed between the first and second long hair sections, a second short hair section disposed immediately adjacent the second long hair section:

wherein the first and second long and short hair sections are arranged in a side-by-side configuration along a lateral direction, and each of the first and second long and short hair sections have a length extending along an anterior-posterior direction parallel to the parting line and a width extending transverse to the length, where the width of the first long hair section is greater than the width of each of the first and second short hair sections and the second long hair section;

knotting a plurality of long hairs in the first and second long hair sections in a first direction;

knotting a plurality of short hairs in the second short hair section in a second direction knotting a plurality of short hairs in the first short hair section in the first or second directions, wherein the first and second directions are different; and knotting a plurality of long hairs to the second area of the net base.

* * * * *